United States Patent [19]

Shih

[11] Patent Number: 4,988,133

[45] Date of Patent: Jan. 29, 1991

[54] LOCK STRUCTURE WITH DIRECTION-CHANGEABLE DEVICE

[76] Inventor: Nan C. Shih, 116, Changtsao Rd., Changhua, Taiwan

[21] Appl. No.: 278,777

[22] Filed: Dec. 2, 1988

[51] Int. Cl.[5] ..... E05C 1/16

[52] U.S. Cl. ..... 292/191; 70/486; 292/192; 292/244

[58] Field of Search ..... 70/462, 486; 292/169.13, 244, 245, 191, 192

[56] References Cited

U.S. PATENT DOCUMENTS

| | | | |
|---|---|---|---|
| 194,789 | 9/1877 | Smith | 292/191 |
| 218,455 | 8/1879 | Russell, Jr. | 292/244 |
| 242,247 | 5/1881 | Bailey | 292/244 |
| 976,784 | 11/1910 | Curlett | 70/486 X |
| 2,107,300 | 2/1938 | Kilpatrick | 292/192 |
| 2,516,991 | 8/1950 | Heyer | 292/244 |
| 3,186,747 | 6/1965 | Hamm et al. | 292/169.14 |
| 3,361,462 | 1/1968 | Foster | 70/462 |

FOREIGN PATENT DOCUMENTS

| | | | |
|---|---|---|---|
| 2034554 | 1/1972 | Fed. Rep. of Germany | 70/462 |
| 239006 | 9/1925 | United Kingdom | 70/462 |
| 1175959 | 1/1970 | United Kingdom | 70/462 |

*Primary Examiner*—Lloyd A. Gall

*Attorney, Agent, or Firm*—Fleit, Jacobson, Cohn, Price, Holman & Stern

[57] ABSTRACT

A direction changeable lock has a latch case, a latch bolt, and a positioning rod which can easily be turned around manually through 180 degrees, so that it does not have a direction limitation when it is to be fixed on a door. The latch bolt has a recess for an anti-burglary bolt therein.

2 Claims, 2 Drawing Sheets

LOCK STRUCTURE WITH DIRECTION-CHANGEABLE DEVICE

BACKGROUND OF THE INVENTION

This invention relates to a lock of the type having a latch bolt and a positioning rod which can easily be changed in its direction in a lock, especially one with a latch bolt and a dead bolt. The latch bolt can automatically extend out of the faceplate when the door is closed and the dead bolt can be extended out by turning a button at the inside of the door or by a key at the outside of the door. As the latch bolt is shaped inclined as a triangular cone, it has a direction limitation when it is to be fixed on a door. Then makers have to produce two different kinds of locks with the latch bolt having a right or a left direction, which gives rise to inconvenience for makers, retailers and users.

SUMMARY OF THE INVENTION

In view of this inconvenience, this invention, a lock structure with direction-changable device, has been devised.

BRIEF DESCRIPTION OF THE DRAWINGS

This invention will now be described in detail with reference to accompanying drawings wherein.

DETAILED DESCRIPTION OF THE INVENTION

Figure 1:
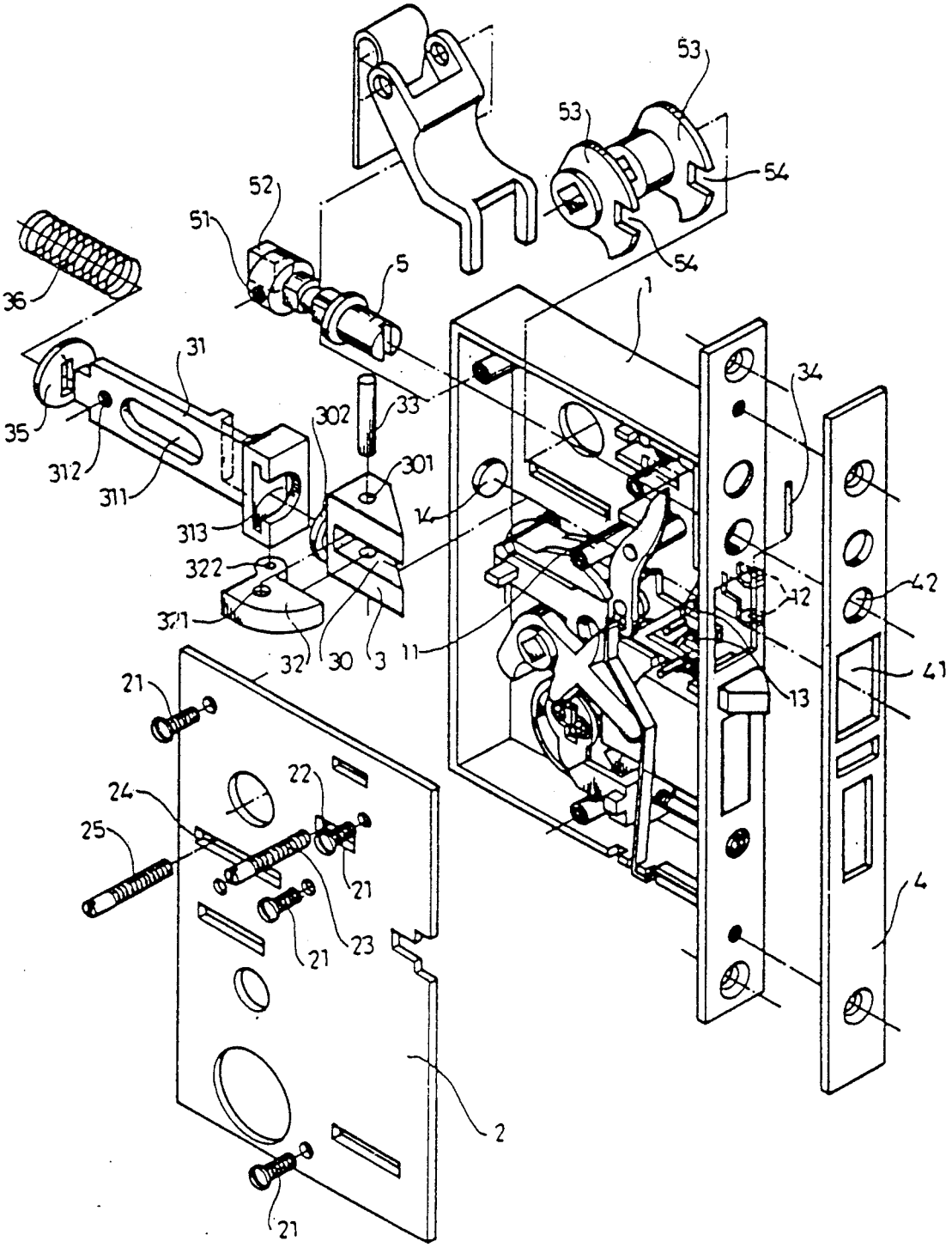
FIG. 1 is an exploded perspective view of the latch bolt changable in its direction combined in a lock in accordance with the present invention.

As shown in FIG. 1, this invention comprises a case 1 for containing moving parts, a lid or side wall 2 fixed with the case 1 with screws 21, a latch bolt 3 extensible out of a latch bolt hole 41 in a faceplate 4, a positioning rod 5 extending in a positioning hole 42 in the faceplate 4, and a shaft 11 passing through an elongate aperture 311 of a latch 31 for limiting the moving scope of the latch bolt 3.

The lid 2 is provided with a lengthwise slot 22 for a positioning screw 23 to pass through to screw in a screw hole 51 in the positioning rod 5 so that the positioning rod 5 can only move within the length of the slot 22. The positioning rod 5 is provided with a protrusion 52 eccentrically positioned at the rear end so as to engage with one of the two notches 54 of two moving plates 53 when the positioning rod 5 is revolved and thus to hamper the moving plates 53 from turning. Therefore, the positioning screw 23 is to be taken off the lid 2 and to insert through a lengthwise slot in the bottom plate of the case 1 to screw hole 51 after the rod 5 has been revolved for 180 degrees to make the protrusion 52 to engage with the other notch 54. Besides, the lid 2 is also provided with another lengthwise slot 24 for a screw 25 to screw in a screw hole 312 in the latch 31 to restrict the moving scope of the latch bolt 3 within the length of the slot 24.

The latch bolt 3 shaped as a triangular cone is provided with a groove 30 for a pivotal cam-type bolt 32 which assists in depressing the latch bolt, in known manner, when it engages a striker plate. The latch bolt has a pin hole 301 to match with a pin hole 321 in the bolt 32 for a positioning pin 33 to nail in, and a disc 302 to insert in a groove 313 in the latch 31.

The latch 31 is provided with an elongate aperture 311 for the shaft 11 of the case 1 to pass through so that the latch 31 can only move within the length of the aperture 311. The latch 31 is also provided with a screw hole 312 for the screw 25 passing through the slot 24 in the lid 2 to screw in so that the latch 31 can only move within the length of the slot 24, said slot 24 being a little shorter than the aperture 311. The end of the latch 31 engages with a disc 35 pushing a coiled spring 36 whose other end pushes a limiting post 14 on the case 1 so that the latch bolt 3 is regularly possible to extend out.

The bolt 32 is combined with the latch bolt 3 by means of the positioning pin 33 and the pin hole 321, and provided with a pin hole 322 for a positioning pin 34 to combine with the ears 12 and 13 provided on opposite sides of the case 1 respectively, and outside of the lid 2 and the opposite case wall.

Figure 3:
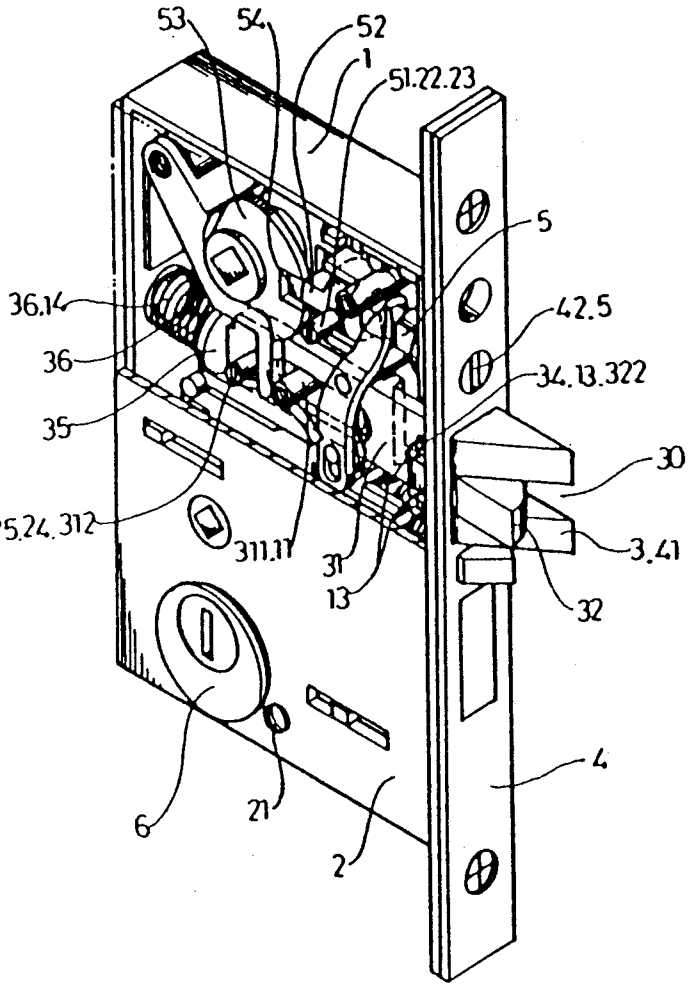
FIG. 3 is a perspective view of the latch bolt changed in its direction in accordance with the present invention.
Figure 2:
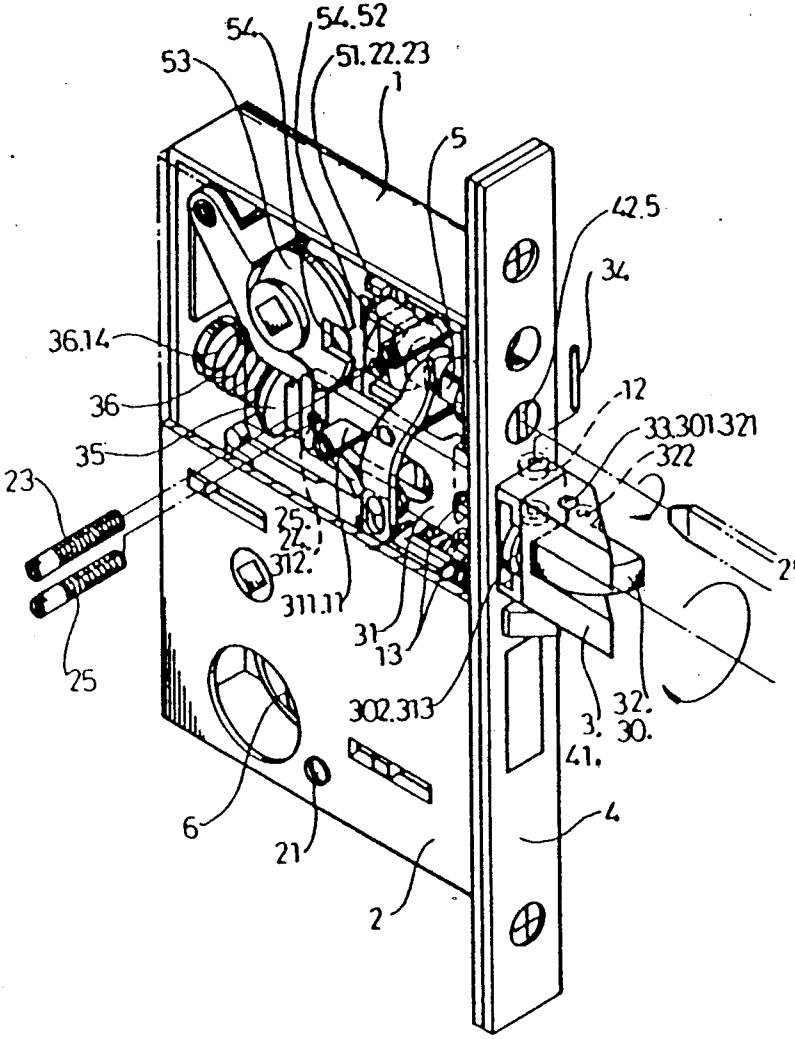
FIG. 2 is a perspective view of the latch bolt extending out in accordance with the present invention.

Next, the most important feature of this invention, shown in FIGS. 2 and 3, is that the latch bolt 3 can be altered in its direction. Now, the latch bolt 3 is wanted to be altered from the position shown in FIG. 2 to the position shown in FIG. 3. The case 1 and lid 2 fixed firmly in the door are not needed to be released off the door, but the positioning screw 23 and the screw 25 are only needed to be released. Next, the lock 6 itself is reversed and the positioning pin 34 is pulled off upward. Then the latch bolt 3 with the bolt 32 can be extended out a little further by the resilient force of the coiled spring 36 as shown in FIG. 2. Under this position, the disc 302 is to be turned around manually for 180 degrees in the groove 313 of the latch 31. Now the latch bolt 3 with the bolt 32 has been altered in its direction as shown in FIG. 3. Then the latch bolt 3 with the latch 31 should be pushed inward to make the pin hole 322 face against the ears 12 and 13 and to insert the positioning pin 34 back therein so as to position the bolt 32. And, the positioning rod 5 is to be turned around manually for 180 degrees, too. Lastly, the positioning screw 23 and the screw 25 are screw back in the screw hole 51 and 312 respectively.

What is claimed is:

1. A direction-changeable lock structure, comprising a latch case having a faceplate and side walls, a sliding latch and a latch bolt provided with a notch or recess therein for pivotally fixing a cam-type bolt therein by means of a positioning pin and a pin hole and a disc located at a rear end of the latch bolt and engaging in a groove of the latch and capable of revolving movement therein, said cam-type bolt having a protrusion with a pin hole therein for a positioning pin to be inserted therethrough as well as through a selected set of a pair of opposing sets of ears with holes therein, said sets being provided on opposite sides of the case respectively, the latch further having a removable transverse pin extending through a movement-limiting slot in one side wall of the case whereby removal of the transverse pin allows increased sliding movement of the latch for projecting the latch bolt through an aperture in the faceplate to allow revolving movement of the latch bolt so as to change its direction.

2. A direction-changeable lock structure as claimed in claim 1, wherein a rotatable positioning rod is provided with a protrusion eccentrically located thereon such that said protrusion can selectively engage with either one of two notches provided on movable plates which are located at a rear end of the positioning rod when the positioning rod is either in a first position or in a second position which is at an angle of 180° with respect to the first position.

* * * * *